US012213520B2

(12) United States Patent
Jang et al.

(10) Patent No.: US 12,213,520 B2
(45) Date of Patent: Feb. 4, 2025

(54) LIQUID CARTRIDGE AND AEROSOL GENERATION DEVICE INCLUDING THE SAME

(71) Applicant: KT&G CORPORATION, Daejeon (KR)

(72) Inventors: Chul Ho Jang, Daejeon (KR); Gyoung Min Go, Daejeon (KR); Sung Hwan Kim, Daejeon (KR); Yong Joon Jang, Daejeon (KR)

(73) Assignee: KT & G CORPORATION, Daejeon (KR)

( * ) Notice: Subject to any disclaimer, the term of this patent is extended or adjusted under 35 U.S.C. 154(b) by 808 days.

(21) Appl. No.: 17/267,285

(22) PCT Filed: Aug. 21, 2020

(86) PCT No.: PCT/KR2020/011181
§ 371 (c)(1),
(2) Date: Feb. 9, 2021

(87) PCT Pub. No.: WO2021/071084
PCT Pub. Date: Apr. 15, 2021

(65) Prior Publication Data

US 2022/0295879 A1 Sep. 22, 2022

(30) Foreign Application Priority Data

Oct. 11, 2019 (KR) ..... 10-2019-0125850

(51) Int. Cl.
*A24F 40/44* (2020.01)
*A24F 40/42* (2020.01)
*A24F 40/485* (2020.01)

(52) U.S. Cl.
CPC ..... *A24F 40/42* (2020.01); *A24F 40/44* (2020.01); *A24F 40/485* (2020.01)

(58) Field of Classification Search
None
See application file for complete search history.

(56) References Cited

U.S. PATENT DOCUMENTS 11,357,262 B2 * 6/2022 Rogan ..... A24F 40/42
11,583,004 B2 * 2/2023 Fraser ..... H05B 3/44
(Continued)

FOREIGN PATENT DOCUMENTS

CN 106998812 A 8/2017
CN 108430244 A 8/2018
(Continued)

OTHER PUBLICATIONS

International Search Report for PCT/KR2020/011181 dated Dec. 2, 2020 [PCT/ISA/210].
(Continued)

*Primary Examiner* — Felix O Figueroa
(74) *Attorney, Agent, or Firm* — Sughrue Mion, PLLC

(57) ABSTRACT

The liquid cartridge includes a storage portion which is configured to store an aerosol-generating substrate in a liquid state and includes an air hole through which air enters, a wick which is configured to absorb the stored aerosol-generating substrate, and a vaporizing portion which is configured to vaporize the aerosol-generating substrate absorbed through the wick to generate an aerosol.

10 Claims, 10 Drawing Sheets

(56) References Cited

U.S. PATENT DOCUMENTS

| | | | |
|---|---|---|---|
| 2013/0081642 | A1 | 4/2013 | Safari |
| 2016/0073692 | A1 | 3/2016 | Alarcon et al. |

FOREIGN PATENT DOCUMENTS

| | | | |
|---|---|---|---|
| JP | 2018-534908 | A | 11/2018 |
| KR | 10-2017-0006282 | A | 1/2017 |
| KR | 10-2018-0124736 | A | 11/2018 |
| KR | 10-2018-0125020 | A | 11/2018 |
| WO | 2015/165812 | A1 | 11/2015 |
| WO | 2017/144374 | A1 | 8/2017 |
| WO | 2018/211035 | A1 | 11/2018 |
| WO | 2019/052787 | A1 | 3/2019 |
| WO | 2019/154811 | A1 | 8/2019 |

OTHER PUBLICATIONS

Written Opinion for PCT/KR2020/011181 dated Dec. 2, 2020 [PCT/ISA/237].
Extended European Search Report issued Dec. 13, 2021 in European Application No. 20804157.4.
Office Action issued Feb. 1, 2022 in Japanese Application No. 2020-560377.

* cited by examiner

[FIG. 1]
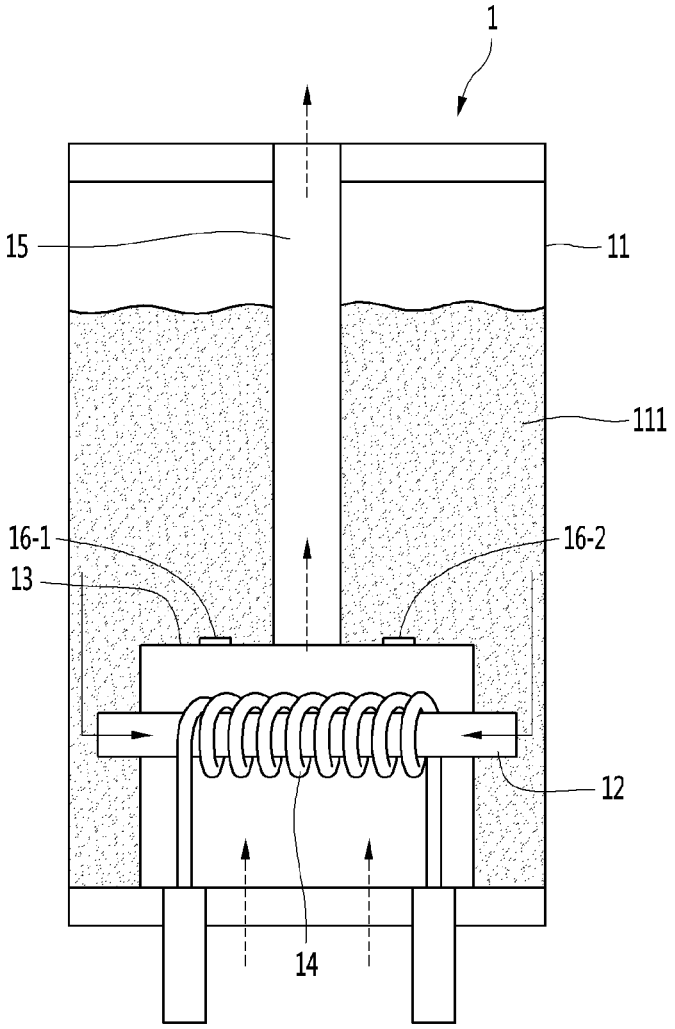

[FIG. 2]
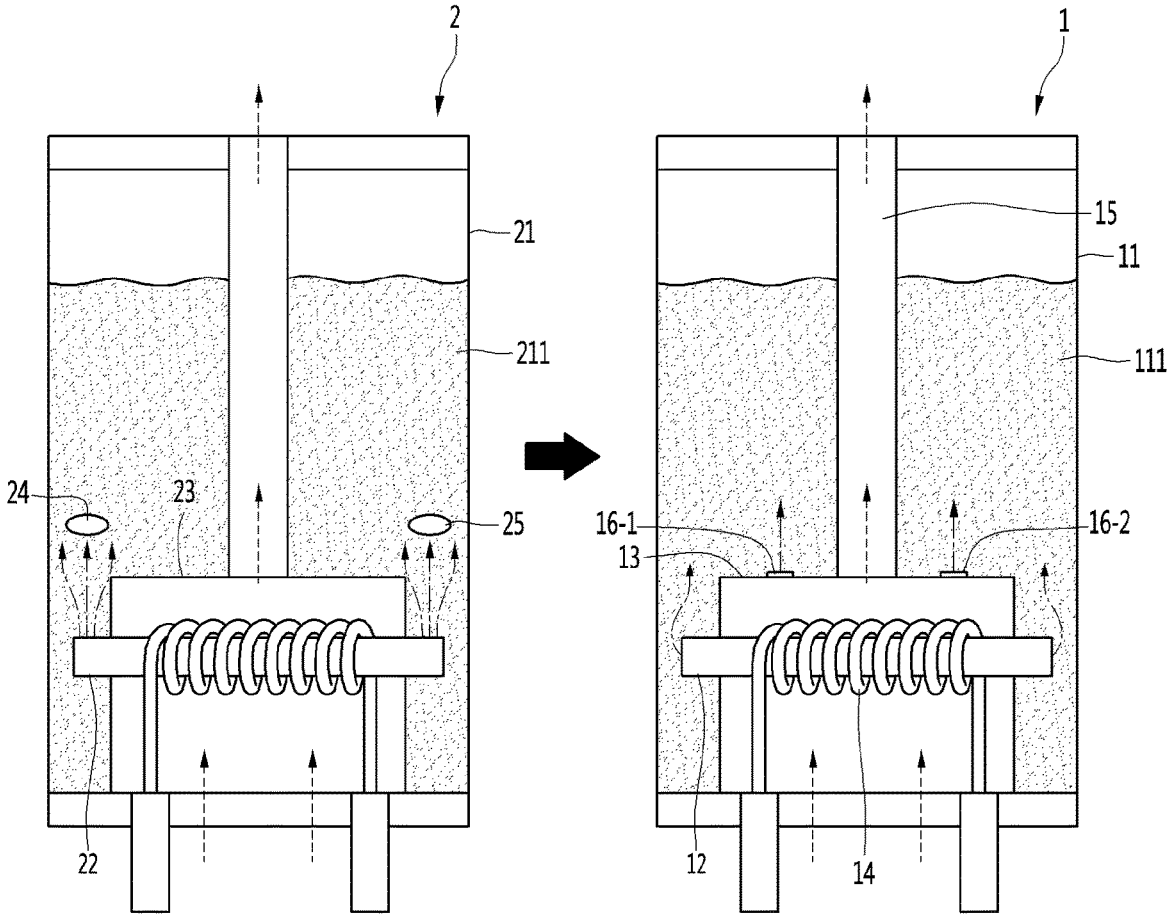

[FIG. 3]
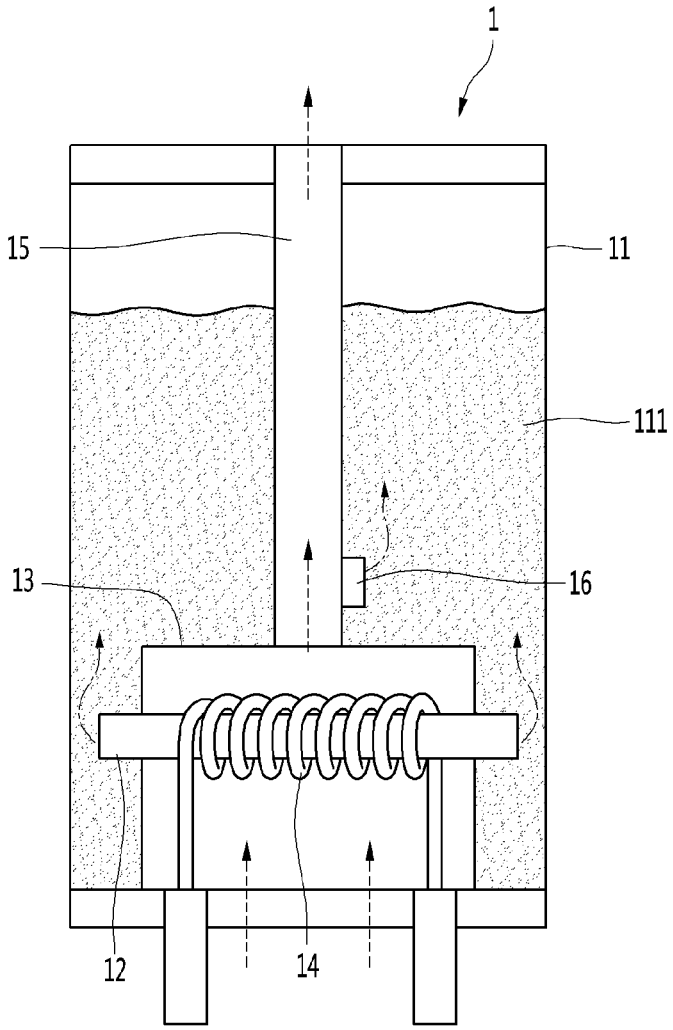

[FIG. 4]
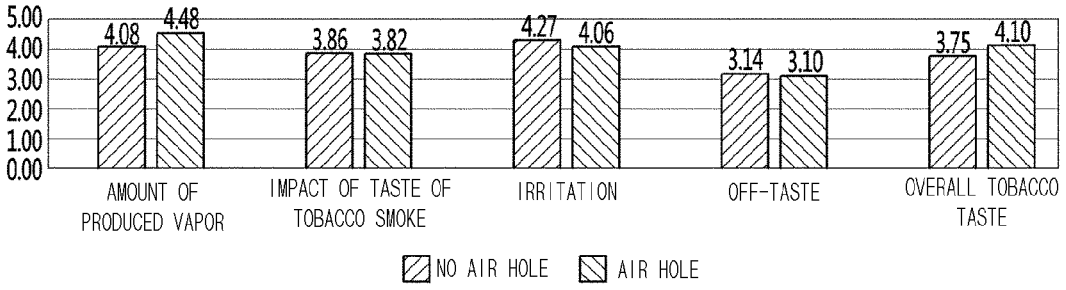
[FIG. 5]
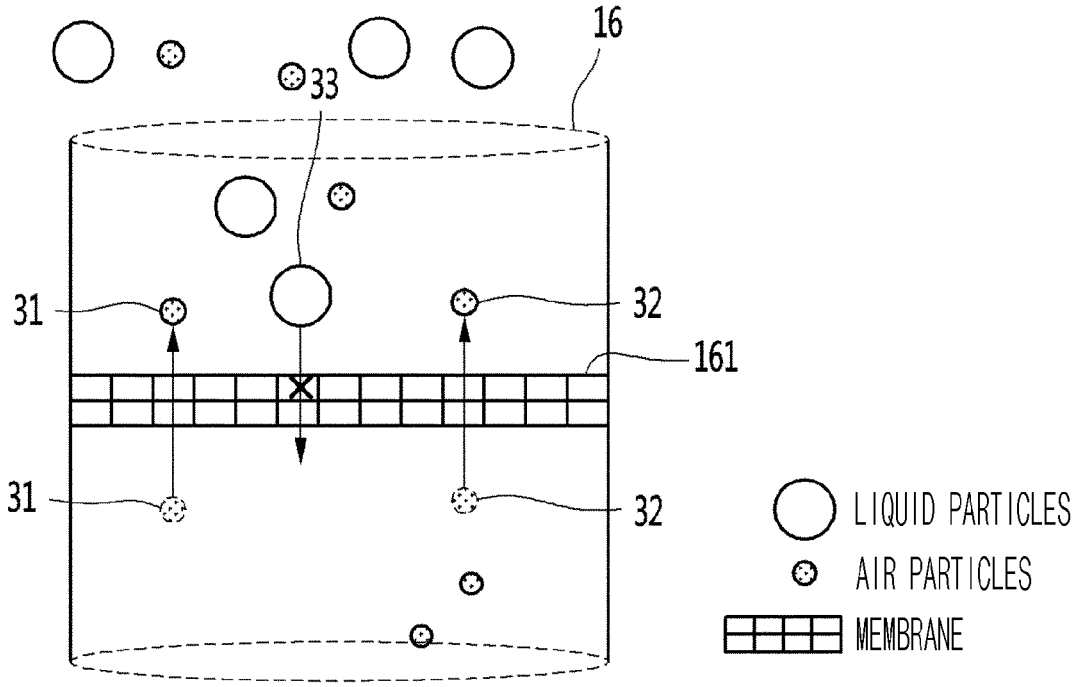

[FIG. 6]
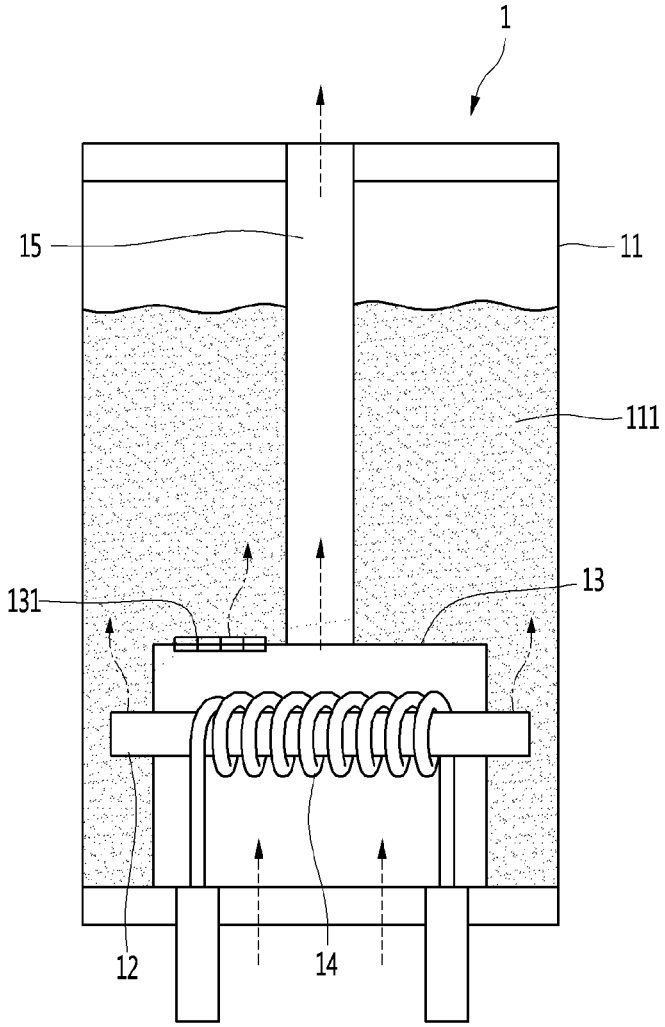

[FIG. 7]
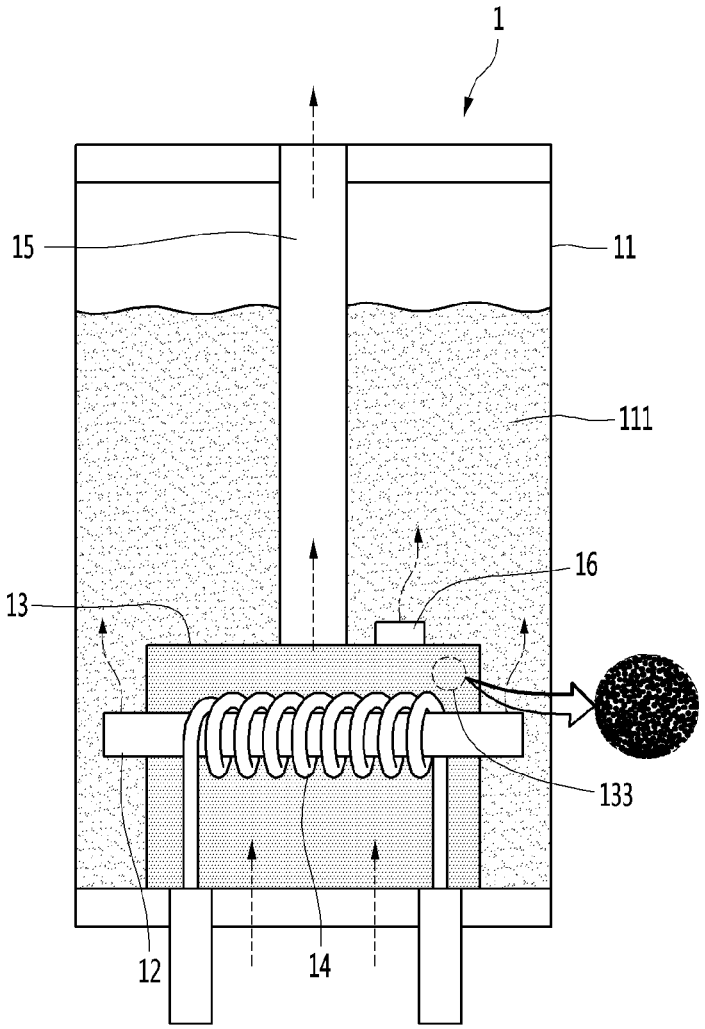

[FIG. 8]
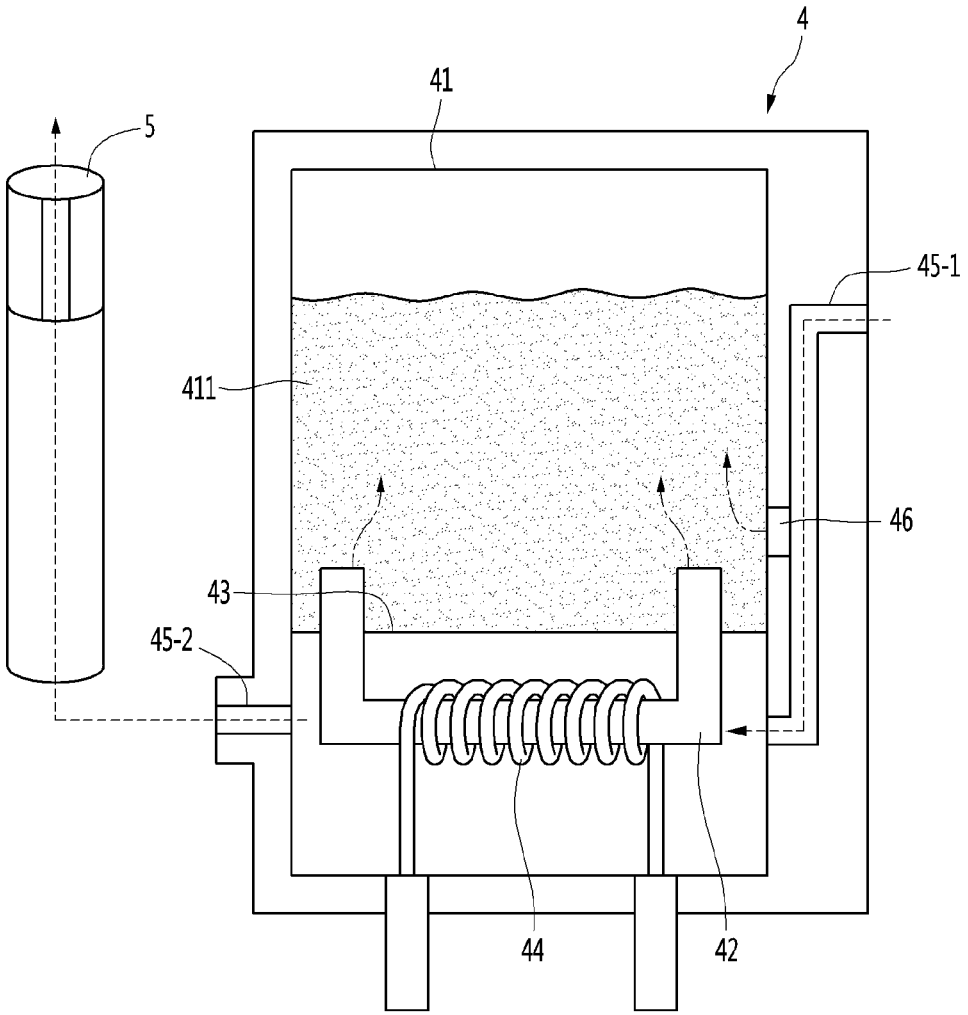

[FIG. 9]
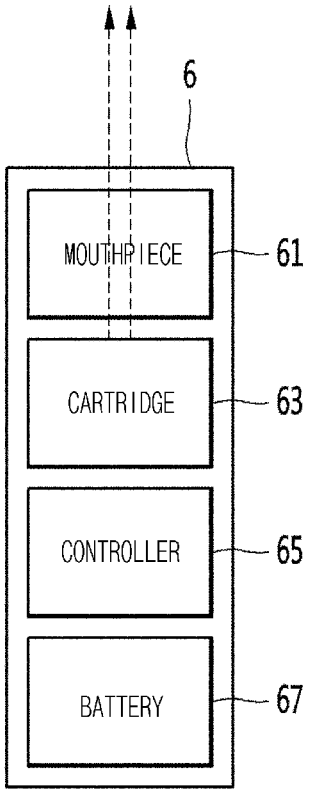

[FIG. 10]
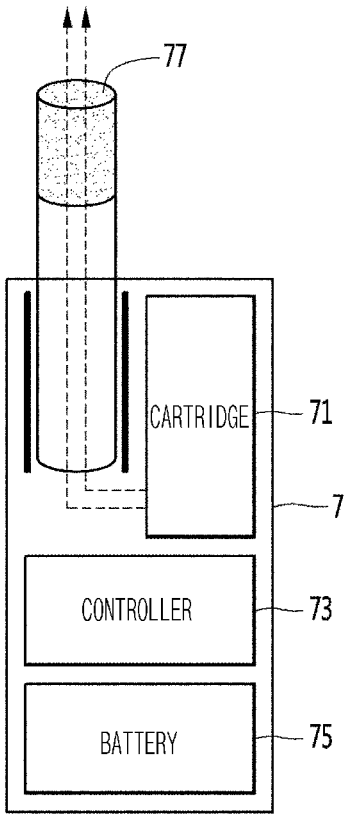

[FIG. 11]
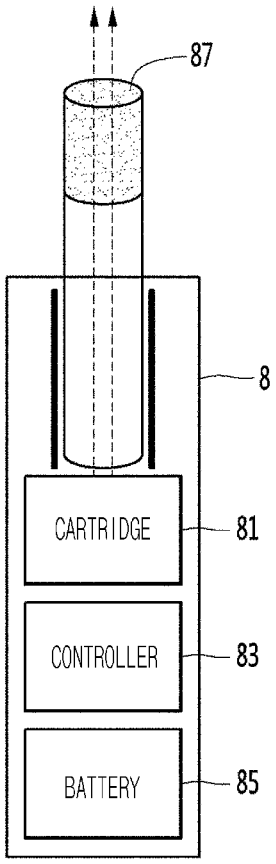

LIQUID CARTRIDGE AND AEROSOL GENERATION DEVICE INCLUDING THE SAME

TECHNICAL FIELD

The present disclosure relates to a liquid cartridge and an aerosol generation device including the same, and more particularly, to a liquid cartridge with an improved liquid supply ability and an aerosol generation device including the same.

BACKGROUND ART

In recent years, demand for alternative smoking articles that overcome disadvantages of general cigarettes has increased. For example, instead of demand for cigarettes, demand for aerosol generation devices that vaporize liquid compositions to generate an aerosol has increased, and accordingly, active research has been carried out on liquid vaporization-type aerosol generation devices.

Generally, a liquid vaporization-type aerosol generation device vaporizes a liquid composition stored in a storage space of a cartridge through a heater to generate an aerosol. Here, when the liquid composition in the storage space is not sufficiently delivered toward the heater, the amount of generated aerosol may be small and the liquid may burn, causing a burnt taste.

DISCLOSURE

Technical Problem

Some embodiments of the present disclosure are directed to providing a liquid cartridge with an improved liquid supply ability and an aerosol generation device including the same.

Some embodiments of the present disclosure are also directed to providing a liquid cartridge, which has an improved liquid supply ability and is capable of minimizing a liquid leakage phenomenon, and an aerosol generation device including the same.

Objectives of the present disclosure are not limited to the above-mentioned objectives, and other unmentioned objectives should be clearly understood by those of ordinary skill in the art to which the present disclosure pertains from the description below.

Technical Solution

A liquid cartridge according to some embodiments of the present disclosure includes a storage portion which is configured to store an aerosol-generating substrate in a liquid state and includes an air hole configured to introduce air, a wick which is configured to absorb the stored aerosol-generating substrate, and a vaporizing portion which is configured to vaporize the aerosol-generating substrate absorbed through the wick to generate an aerosol.

In some embodiments, a size of the air hole may be in a range of 0.15 $mm^2$ to 0.60 $mm^2$.

In some embodiments, the liquid cartridge may further include a wick housing surrounding the wick, and the air hole may be disposed at a connection portion between the wick housing and the storage portion so that air inside the wick housing enters the storage portion.

In some embodiments, the liquid cartridge may further include an airflow tube through which the generated aerosol or air is delivered, and the air hole may be disposed at a connection portion between the airflow tube and the storage portion so that air inside the airflow tube enters the storage portion.

In some embodiments, the liquid cartridge may further include a wick housing surrounding the wick and including a porous material.

In some embodiments, a semipermeable membrane configured to prevent the stored aerosol-generating substrate from leaking out of the storage portion may be disposed in the air hole.

A liquid cartridge according to some other embodiments of the present disclosure includes a storage portion which is configured to store an aerosol-generating substrate in a liquid state and has at least a portion implemented with a semipermeable material that prevents the stored aerosol-generating substrate from leaking out of the storage portion and allows air to enter the storage portion, a wick which is configured to absorb the stored aerosol-generating substrate, and a vaporizing portion which is configured to generate an aerosol by vaporizing the aerosol-generating substrate absorbed in the wick.

In some embodiments, the liquid cartridge may further include a wick housing surrounding the wick, and at least a portion of a connection portion between the storage portion and the wick housing may be implemented with the semipermeable material so that air inside the wick housing enters the storage portion.

In some embodiments, the liquid cartridge may further include an airflow tube through which the generated aerosol or air is delivered, and at least a portion of a connection portion between the airflow tube and the storage portion may be implemented with the semipermeable material so that air inside the airflow tube enters the storage portion.

An aerosol generation device according to some embodiments of the present disclosure includes a liquid cartridge including at least one air hole through which air enters a storage portion which stores an aerosol-generating substrate in a liquid state, a battery configured to supply power to the liquid cartridge, and a controller configured to control the battery and the liquid cartridge.

Advantageous Effects

According to various embodiments of the present disclosure, since air enters a storage portion of a liquid cartridge through an air hole, positions where bubbles are generated may be dispersed in the storage portion. Accordingly, the formation of bubble layers at both ends of a wick is prevented, and thus a problem that a liquid supply ability of the liquid cartridge is degraded due to the bubble layers can be addressed.

Also, as the liquid supply ability of the liquid cartridge is improved, the amount of aerosol generated by an aerosol generation device is increased, a problem that a burnt taste is caused by liquid supply can be addressed, and the overall tobacco taste sensed by a user can be enhanced.

In addition, by utilizing a semipermeable material (or matter) such as a membrane, a phenomenon in which a liquid leaks out of the storage portion through the air hole can be prevented. Accordingly, a phenomenon in which the liquid leaks from the liquid cartridge can be minimized, and user satisfaction can be further enhanced.

The advantageous effects according to the technical idea of the present disclosure are not limited to the above-mentioned advantageous effects, and other unmentioned advantageous effects should be clearly understood by those of ordinary skill in the art from the description below.

DESCRIPTION OF DRAWINGS

FIG. 1 is an exemplary configuration diagram illustrating a liquid cartridge according to some embodiments of the present disclosure.

FIG. 2 is a view for further explaining the reason why the liquid supply ability of the liquid cartridge is degraded.

FIG. 3 is an exemplary view for describing a position of an air hole of the liquid cartridge according to some embodiments of the present disclosure.

FIG. 4 illustrates results of sensory evaluation of the liquid cartridge according to some embodiments of the present disclosure.

FIGS. 5 and 6 are exemplary views for describing a case in which a membrane is applied to the liquid cartridge according to some embodiments of the present disclosure.

FIG. 7 is an exemplary view for describing a case in which a porous material is applied to the liquid cartridge according to some embodiments of the present disclosure.

FIG. 8 is an exemplary configuration diagram illustrating a liquid cartridge according to some other embodiments of the present disclosure.

FIGS. 9 to 11 are exemplary block diagrams of an aerosol generation device according to various embodiments of the present disclosure.

MODES OF THE INVENTION

Hereinafter, exemplary embodiments of the present disclosure will be described in detail with reference to the accompanying drawings. Advantages and features of the present disclosure and a method of achieving the same should become clear with embodiments described in detail below with reference to the accompanying drawings. However, the technical idea of the present disclosure is not limited to the following embodiments and may be implemented in various other forms. The embodiments make the technical idea of the present disclosure complete and are provided to completely inform those of ordinary skill in the art to which the present disclosure pertains of the scope of the present disclosure. The technical idea of the present disclosure is defined only by the scope of the claims.

In assigning reference numerals to elements of each drawing, it should be noted that the same reference numerals are assigned to the same elements as much as possible even when the elements are illustrated in different drawings. Also, in describing the present disclosure, when detailed description of a known related configuration or function of the prior art is deemed as having the possibility of obscuring the gist of the present disclosure, the detailed description thereof will be omitted.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein. Terms used herein are for describing the embodiments and are not intended to limit the present disclosure. In the specification, a singular expression includes a plural expression unless the context clearly indicates otherwise.

Also, in describing elements of the present disclosure, terms such as first, second, A, B, (a), and (b) may be used. Such terms are only used for distinguishing one element from another element, and the essence, order, sequence, or the like of the corresponding element is not limited by the terms. In a case in which a certain element is described as being "connected," "coupled," or "linked" to another element, it should be understood that, although the element may be directly connected or linked to the other element, still another element may also be "connected," "coupled," or "linked" between the two elements.

The terms "comprises" and/or "comprising" used herein do not preclude the presence of or the possibility of adding one or more elements, steps, operations, and/or devices other than those mentioned.

Prior to the description of various embodiments of the present disclosure, some terms used herein will be clarified.

In the present specification, "aerosol generation device" may refer to a device that generates an aerosol using an aerosol-generating substrate in order to generate an aerosol that can be inhaled directly into the user's lungs through the user's mouth. Examples of the aerosol generation device may include a liquid-type aerosol generation device using a liquid cartridge and a hybrid-type aerosol generation device using a liquid cartridge and a cigarette together. However, the examples of the aerosol generation device may further include various other kinds of aerosol generation devices, and the scope of the present disclosure is not limited to the above-listed examples. Some examples of the aerosol generation device will be described below with reference to FIGS. 9 to 11.

Hereinafter, various embodiments of the present disclosure will be described in detail with reference to the accompanying drawings.

First, liquid cartridges according to various embodiments of the present disclosure will be described with reference to FIGS. 1 to 8, and then some examples of the aerosol generation device that may be applied to the liquid cartridge will be described.

FIG. 1 is an exemplary configuration diagram illustrating a liquid cartridge 1 according to some embodiments of the present disclosure. In FIG. 1, the solid arrows indicate a delivery path of a liquid, and dotted arrows represent a delivery path of air or an aerosol. The dotted arrows in the other drawings also indicate a delivery path of air or an aerosol.

As illustrated in FIG. 1, the liquid cartridge 1 may include a storage portion 11, a wick 12, a wick housing 13, a vaporizing portion 14, and an airflow tube 15. However, FIG. 1 only shows some elements relating to the embodiment of the present disclosure. Therefore, those of ordinary skill in the art to which the present disclosure pertains should understand that the liquid cartridge 1 may further include general-purpose elements other than the elements illustrated in FIG. 1. Also, in some other embodiments of the present disclosure, at least some of the elements illustrated in FIG. 1 may be omitted or substituted with other elements. Hereinafter, each element of the liquid cartridge 1 will be described. Also, hereinafter, for convenience of description, "liquid cartridge" will be shortly referred to as "cartridge."

The storage portion 11 may have a predetermined space therein, and an aerosol-generating substrate 111 in a liquid state may be stored in the space. Also, the storage portion 11 may supply the stored aerosol-generating substrate 111 to the vaporizing portion 14 through the wick 12.

The aerosol-generating substrate 111 may refer to a liquid composition including one or more aerosol-generating materials. For example, the aerosol-generating substrate 111 may include at least one of propylene glycol (PG) and glycerin (GLY) and may further include at least one of ethylene glycol, dipropylene glycol, diethylene glycol, triethylene glycol, tetraethylene glycol, and oleyl alcohol. As another example, the aerosol-generating substrate 111 may further include at least one of nicotine, moisture, and a flavoring material. As still another example, the aerosol-generating substrate 111 may further include various additives such as cinnamon and capsaicin. The aerosol-generating substrate 111 may include not only a liquid material with high fluidity but also a material in the form of gel or solid. In this way, as the materials constituting the aerosol-generating substrate 111, various materials may be selected according to embodiments, and mixing ratios thereof may also vary according to embodiments.

Next, the wick 12 may absorb the aerosol-generating substrate 111 stored in the storage portion 11 and deliver the absorbed aerosol-generating substrate 111 to the vaporizing portion 14. The wick 12 may be implemented with a material, such as cotton and silica, that may easily absorb a liquid material, but the scope of the present disclosure is not limited to such examples. The wick 12 may be implemented with any other material as long as the wick 12 is able to deliver the aerosol-generating substrate 111 to the vaporizing portion 14.

Next, the wick housing 13 may refer to a portion surrounding the wick 12, and materials and/or characteristics of the wick housing 13 may vary according to embodiments.

Next, the vaporizing portion 14 may vaporize the aerosol-generating substrate absorbed into the wick 12 to generate an aerosol. For example, as illustrated in FIG. 1, the vaporizing portion 14 may include a coil wound around the wick 12 and heat the coil to generate an aerosol from the aerosol-generating substrate absorbed into the wick 12. However, the scope of the present disclosure is not limited to the above example, and the vaporizing portion 14 may be implemented in any other way as long as the vaporizing portion 14 is able to vaporize the aerosol-generating substrate. For example, the vaporizing portion 14 may also be implemented with a module that induces an aerosol-generating substrate in a liquid state to be aerosolized through diffusion or evaporation without heating the aerosol-generating substrate in the liquid state.

Next, the airflow tube 15 may refer to a passage along which gas, such as an aerosol and air, is delivered. For example, air that enters the cartridge 1 from a lower end portion of the cartridge 1 and an aerosol generated in the vaporizing portion 14 may be delivered toward an upper end of the cartridge 1 (that is, toward a mouth of a user) through the airflow tube 15. However, FIG. 1 only assumes that inhalation by the user is performed at the upper end of the cartridge 1, and the form of the airflow tube 15 and the delivery path may be changed according to the design of the aerosol generation device and/or the airflow tube 15. One or more air holes or airflow tubes may be disposed at the lower end portion of the cartridge 1 to allow air to be introduced.

In various embodiments of the present disclosure, the cartridge 1 may include one or more air holes 16-1 and 16-2 which allow air to enter the storage portion 11 and generate bubbles. The air holes 16-1 and 16-2 may allow air to enter the storage portion 11 to prevent an internal pressure of the storage portion 11 from dropping due to a decrease in the amount of the liquid and maintain the liquid supply ability of the storage portion 11. In addition, the air holes 16-1 and 16-2 may disperse positions where bubbles are generated in the storage portion 11 to prevent a phenomenon in which the liquid supply ability of the storage portion 11 is degraded due to formation of bubble layers. To provide more convenience in understanding, the reason why the liquid supply ability is degraded due to the formation of bubble layers will be further explained with reference to FIG. 2.

FIG. 2 shows a comparison between a cartridge 2 without air holes and the cartridge 1 with the air holes, as to where bubbles are generated and whether bubble layers are formed. In FIG. 2 and the subsequent drawings, dash-dot arrows indicate the generation of bubbles.

Referring to FIG. 2, an aerosol-generating substrate 211 stored inside a storage portion 21 is gradually consumed in a smoking process, and an internal pressure of the storage portion 21 drops due to the consumption of the aerosol-generating substrate 211. In order to compensate for the internal pressure drop, a phenomenon occurs in which air enters the storage portion 21 through a wick 22 in an opposite direction to a liquid flow. However, since portions of the wick 22 excluding both ends thereof are sealed by a wick housing 23, air enters the storage portion 21 only through the both ends of the wick 22, and thus bubbles 24 and 25 are intensively generated in the vicinity of the both ends of the wick 22. When the generated bubbles 24 and 25 grow by merging with other bubbles, bubble layers are formed in the vicinity of the both ends of the wick 22. The bubble layers interfere with a liquid flow toward the wick 22, and the liquid supply ability of the storage portion 21 is degraded. When the liquid supply ability is degraded, since vaporization by heat occurs while the aerosol-generating substrate 211 is not sufficiently absorbed into the wick 22. As a result, a burnt taste is caused and an amount of generated aerosol is reduced.

However, the cartridge 1 including the air holes 16-1 and 16-2 according to the embodiment of the present disclosure may allow air inside the wick housing 13 to additionally enter the storage portion 11 through the air holes 16-1 and 16-2 and disperse the positions where bubbles are generated. That is, instead of being concentrated at both ends of the wick 12, bubbles are also generated in the vicinity of the air holes 16-1 and 16-2. Accordingly, since formation of bubble layers due to merging of bubbles is prevented and an inflow of air is further facilitated, the liquid supply ability of the storage portion 11 may be maintained despite the decrease in the amount of the aerosol-generating substrate 111.

Meanwhile, FIGS. 1 and 2 illustrate an example in which the cartridge 1 includes the two air holes 16-1 and 16-2 which are disposed at connection portions between the storage portion 11 and the wick housing 13 so that the air inside the wick housing 13 may enter the storage portion 11. However, the positions and number of air holes may be designed and selected in various ways according to embodiments. For example, a first air hole may be disposed at a first position of the storage portion 11, a second air hole may be disposed at a second position of the storage portion 11, and a third air hole may be disposed at a third position of the storage portion 11. In the description below, the reference numeral "16" will be used to collectively refer to the air holes 16-1 and 16-2 or refer to any of the air holes 16-1 and 16-2.

In some embodiments, as illustrated in FIG. 3, the air hole 16 may be disposed at a connection portion between the storage portion 11 and the airflow tube 15. In such a case, air inside the airflow tube 15 enters the storage portion 11 so that the internal pressure of the storage portion 11 is prevented from dropping, and the positions where bubbles are generated are dispersed so that the liquid supply ability of the storage portion 11 is maintained regardless of the amount of the liquid in the storage portion 11.

Preferably, the air hole 16 may be disposed close to a lower end portion of the storage portion 11 (e.g., at a position that does not expose the air hole 16 above the liquid surface until the liquid is sufficiently exhausted). This is because, if the air hole 16 is disposed close to an upper end portion of the storage portion 11 (e.g., at a position higher than the aerosol-generating substrate 111 in FIG. 3), an air layer formed in an empty space of the storage portion 11 (that is, an air layer formed above the liquid surface) becomes heavy due to air entering the storage portion 11 and presses down the liquid (e.g., the aerosol-generating substrate 111), which may accelerate liquid leakage from the wick housing 13, the vaporizing portion 14, or the lower end portion (e.g., a lower portion through which air enters) of the cartridge 1.

The air hole 16 needs to be designed in an appropriate size so that the liquid leakage phenomenon does not occur and the inflow of air is facilitated. This is because, when the size of the air hole 16 is too large, the liquid leakage phenomenon may occur through the air hole 16. On the other hand, when the size of the air hole 16 is too small, the inflow of air may not be facilitated. The size of the air hole 16 may vary according to embodiments, but preferably, the size of the air hole 16 may be in a range of 0.15 $mm^2$ to 0.60 $mm^2$.

Table 1 and Table 2 below show experimental results according to the presence or absence of the air hole 16 and show results of analyzing components of an aerosol generated through an aerosol generation device (e.g., a hybrid-type aerosol generation device of FIG. 10). Table 1 shows an experimental result relating to a single air hole 16 having a size of 0.15 $mm^2$, and Table 2 shows an experimental result relating to a single air hole 16 having a size of 0.60 $mm^2$.

TABLE 1

| Presence of air hole | Units | TPM | Tar | Nicotine | PG | GLY | Moisture | Amount of consumed liquid |
|---|---|---|---|---|---|---|---|---|
| X | mg/ | 45.4 | 21.8 | 0.56 | 1.8 | 7.65 | 23.0 | 40.9 |
| O | stick | 46.0 | 22.1 | 0.58 | 2.0 | 7.9 | 23.5 | 42.1 |

TABLE 2

| Presence of air hole | Unit | TPM | Tar | Nicotine | PG | GLY | Moisture | Amount of consumed liquid |
|---|---|---|---|---|---|---|---|---|
| X | mg/ | 45.4 | 21.8 | 0.56 | 1.8 | 7.65 | 23.0 | 40.9 |
| O | stick | 48.4 | 23.3 | 0.62 | 2.2 | 9.1 | 24.5 | 47.1 |

Referring to Table 1 and Table 2, it can be seen that the amount of consumed liquid increases with an increase in the size of the air hole 16. This indicates that the liquid supply ability of the storage portion 11 is improved as the inflow of air into the storage portion 11 is more facilitated.

Also, as shown in Table 2, it can be seen that, in the case of the cartridge 1 including the air hole 16, the amount of consumed liquid increased by about 15%, the amount of supplied nicotine increased by about 10%, and the amount of supplied glycerin increased by about 21%. This shows that the air hole 16 greatly contributes to an improvement in the liquid supply ability of the storage portion 11.

FIG. 4 illustrates results of sensory evaluation performed under the experimental conditions of Table 2.

As illustrated in FIG. 4, it can be seen that, as a result of using the cartridge 1 including the air hole, the amount of produced vapor (that is, the amount of generated aerosol) increased significantly and irritation and off-taste decreased. The amount of produced vapor and irritation relate to glycerin (GLY). It can be understood that the amount of produced vapor increased and the irritation decreased due to an increase in the amount of supplied glycerin (GLY) that was caused by improvement in the liquid supply ability. Also, the decrease in the off-taste can be understood to be due to a sufficient supply of liquid, which decreased a burnt taste.

Also, as illustrated in FIG. 4, it can be seen that the overall tobacco taste was enhanced significantly. It can be understood that the overall tobacco taste sensed by a user improved because the amount of produced vapor increased while the off-taste decreased.

Meanwhile, in some other embodiments of the present disclosure, the size of the air hole 16 may also be designed to exceed 0.60 $mm^2$. In such a case, in order to prevent the liquid leakage phenomenon, a predetermined absorber may be attached around the air hole 16. For example, in a case in which the air hole 16 is disposed at the connection portion between the storage portion 11 and the airflow tube 15, a predetermined absorber (e.g., sponge) may be attached in the vicinity of the air hole 16 of the airflow tube 15. According to the present embodiment, the occurrence of the liquid leakage phenomenon may be minimized while the liquid supply ability of the storage portion 11 is improved.

Also, in some embodiments, the air hole 16 may include a plurality of holes forming a mesh structure (e.g., a net-like structure). Alternatively, a plurality of small air holes 16 may form a mesh structure. As such, the liquid leakage phenomenon in which the aerosol-generating substrate 111 leaks out of the storage portion 11 may be prevented.

Also, in some embodiments, a semipermeable membrane may be disposed in the air hole 16. Here, the membrane may include any kind of semipermeable material (or matter), and the scope of the present disclosure is not limited to a specific kind of membrane.

As illustrated in FIG. 5, a membrane 161 disposed in the air hole 16 may allow outside air 31 and 32 to enter the storage portion 11 but prevent an aerosol-generating substrate 33 from leaking out of the storage portion 11. In some examples, the size of the air hole 16 in which the membrane 161 is disposed may exceed 0.60 $mm^2$. This is because the membrane 161 may prevent the liquid leakage phenomenon that may be caused by the air hole 16. According to such an embodiment, the liquid leakage phenomenon due to the air hole 16 may be minimized while the liquid supply ability of the cartridge 1 is improved.

The membrane 161 may be effective in preventing the liquid leakage phenomenon especially in a situation in which an external pressure of the cartridge 1 has dropped. Specifically, in the situation in which the external pressure has dropped (e.g., a case in which the cartridge 1 is being transported by plane), the liquid leakage phenomenon may occur due to expansion of gas inside the storage portion 11, and the air hole 16 may further accelerate the liquid leakage phenomenon. However, when the membrane 161 is disposed, since the liquid does not leak out of the storage portion 11, the liquid leakage phenomenon may be effectively prevented even in the situation in which the external pressure changes.

In some embodiments, a membrane (e.g., the membrane 161) may also be disposed in the airflow tube 15. When an aerosol that is cooled and liquefied while passing through the airflow tube 15, the user may inhale the aerosol in the liquid state and feel uncomfortable. It can be understood that the present embodiment may prevent such a liquid inhalation problem by using the membrane.

Meanwhile, in some other embodiments of the present disclosure, a semipermeable material such as a membrane may also be utilized to implement a portion of the storage portion 11.

For example, as illustrated in FIG. 6, at least a portion of the connection portion between the storage portion 11 and the wick housing 13 may be provided with a membrane 131. In this case, the liquid leakage phenomenon may still be prevented because the membrane 131 prevents the aerosol-generating substrate 111 from leaking out of the storage portion 11. Also, since air inside the wick housing 13 enters the storage portion 11 through the membrane 131, the liquid supply ability of the storage portion 11 may still be improved.

As another example, at least a portion of the connection portion between the storage portion 11 and the airflow tube 15 may be provided with a membrane (e.g., the membrane 131). Since the air inside the airflow tube 15 enters the storage portion 11 and the positions where bubbles are generated are dispersed, the liquid supply ability of the storage portion 11 may be improved. Of course, due to the characteristics of the membrane (e.g., the membrane 131), the liquid leakage phenomenon may still be minimized.

Also, in some embodiments of the present disclosure, a porous material may also be included in the wick housing 13. For example, the porous material may include any material having a porosity that allows the inflow of air and prevents the leakage of liquid. More specifically, as illustrated in FIG. 7, a porous material 133 may be included in the wick housing 13, and the air hole 16 may be disposed at the connection portion between the wick housing 13 and the storage portion 11. In such a case, the air inside the wick housing 13 may enter the storage portion 11 through the air hole 16, but the leakage of the aerosol-generating substrate 111 through the air hole 16 may be prevented by the porous material 133.

Various embodiments relating to the air hole 16 and the membranes (e.g., the membranes 131 and 161) have been described above with reference to FIGS. 1 to 7. The above-described embodiments may be combined in various ways to improve the liquid supply ability of the cartridge 1. For example, the storage portion 11 of the cartridge 1 may include a first air hole in which a membrane is disposed and a second air hole in which a membrane is not disposed. In such a case, a size of the first air hole may be larger than a size of the second air hole. As another example, a porous material may be included in the wick housing 13 while a membrane is disposed in the air hole 16.

Hereinafter, an example of a cartridge 4 that may be applied to a hybrid-type aerosol generation device (e.g., an aerosol generation device 7 of FIG. 10) will be described with reference to FIG. 8.

As illustrated in FIG. 8, the overall configuration of the cartridge 4 is similar to that of the cartridge 1 described above. Therefore, description of details overlapping with those of the cartridge 1 will be omitted, and differences from the cartridge 1 will be mainly described.

FIG. 8 only shows some elements relating to the embodiment of the present disclosure. Therefore, those of ordinary skill in the art to which the present disclosure pertains should understand that the cartridge 4 may further include general-purpose elements other than the elements illustrated in FIG. 8. Also, in some other embodiments of the present disclosure, at least some of the elements illustrated in FIG. 8 may be omitted or substituted with other elements.

Unlike the cartridge 1 described above, the cartridge 4 may include a first airflow tube 45-1 and a second airflow tube 45-2.

The first airflow tube 45-1 may allow air outside the cartridge 4 to enter the cartridge 4. The air that enters the cartridge 4 may be delivered to the outside of the cartridge 4 through the second airflow tube 45-2 together with an aerosol generated in a vaporizing portion 44. When the user inhales, the aerosol may pass through a cigarette 5 and be delivered to the user.

In order to improve the liquid supply ability of the cartridge 4, the technical idea incorporated in the cartridge 1 may be applied identically to the cartridge 4. For example, as illustrated in FIG. 8, a predetermined air hole 46 may be disposed at a connection portion between a storage portion 41 and the first airflow tube 45-1. In such a case, air passing through the first airflow tube 45-1 enters the storage portion 41. As a result, an internal pressure of the storage portion 41 may be prevented from dropping due to the decrease in the amount of a liquid 411, and positions where bubbles are generated may be dispersed.

In addition, various embodiments relating to the cartridge 1 may be applied identically to the cartridge 4. For example, the air hole 46 may be disposed at a connection portion between the storage portion 41 and a wick housing 43, and a membrane may also be disposed.

Refer to the above-given description of the cartridge 1 for description of the storage portion 41, a wick 42, the wick housing 43, and the vaporizing portion 44 that constitute the cartridge 4.

The cartridges 1 and 4 according to various embodiments of the present disclosure have been described above with reference to FIGS. 1 to 8. Hereinafter, some examples of an aerosol generation device to which the cartridges 1 and 4 may be applied will be described with reference to FIGS. 9 to 11.

FIGS. 9 to 11 are exemplary block diagrams of an aerosol generation device according to various embodiments of the present disclosure. More specifically, FIG. 9 is an exemplary block diagram of a liquid-type aerosol generation device, and FIGS. 10 and 11 are exemplary block diagrams of hybrid-type aerosol generation devices that use a liquid cartridge and a cigarette together.

As illustrated in FIG. 9, an aerosol generation device 6 according to some embodiments of the present disclosure may include a mouthpiece 61, a cartridge 63, a battery 67, and a controller 65. However, this is merely a preferred embodiment for achieving the objectives of the present disclosure, and of course, some elements may be added or omitted as necessary. Also, the elements of the aerosol generation device 6 shown in FIG. 9 represent functional elements that are functionally distinct, and the plurality of elements may be implemented to be integrated with each other in an actual physical environment, or a single element may be implemented to be divided into a plurality of specific functional elements. Hereinafter, each element of the aerosol generation device 6 will be described.

The mouthpiece 61 may be disposed at one end of the aerosol generation device 6 and come in contact with a mouth of a user so that the user may inhale an aerosol generated from the cartridge 63.

Next, the cartridge 63 may correspond to the cartridges 1 and 4 described above with reference to FIGS. 1 to 8. In order to avoid repeated description, the description of the cartridge 63 will be omitted.

Next, the battery 67 may supply power used to operate the aerosol generation device 6. For example, the battery 67 may supply power to allow a vaporizing portion of the cartridge 63 to heat an aerosol-generating substrate and may supply power required for the controller 65 to operate.

Also, the battery 67 may supply power required to operate electrical components such as a display (not illustrated), a sensor (not illustrated), and a motor (not illustrated) which are installed in the aerosol generation device 6.

Next, the controller 65 may control the overall operation of the aerosol generation device 6. For example, the controller 65 may control the operation of the cartridge 63 and the battery 67 and also control the operation of other components included in the aerosol generation device 6. The controller 65 may control power supplied by the battery 67, a heating temperature of the vaporizing portion included in the cartridge 63, and the like. Also, the controller 65 may check a state of each component of the aerosol generation device 6 and determine whether the aerosol generation device 6 is in an operable state.

The controller 65 may be implemented by at least one processor. The processor may also be implemented with an array of a plurality of logic gates or implemented with a combination of a general-purpose microprocessor and a memory which stores a program that may be executed by the microprocessor. Also, those of ordinary skill in the art to which the present disclosure pertains should understand that the controller 65 may also be implemented with other forms of hardware.

Meanwhile, in some embodiments, the aerosol generation device 6 may further include an input device (not illustrated) to receive a user input. The input device may be implemented with a switch or a button, but the scope of the present disclosure is not limited thereto. In the present embodiment, the controller 65 may control the aerosol generation device 6 in response to a user input received through the input device. For example, the controller 65 may control the aerosol generation device 6 to generate an aerosol as the user operates a switch or a button.

Meanwhile, since a temperature of the generated aerosol decreases in a process in which the aerosol moves along an airflow tube of the cartridge 63, it may be difficult for a user to feel the warmth of the aerosol as when smoking a general cigarette. Also, as the aerosol with a decreased temperature is liquefied again, a user may inhale the aerosol in the form of droplets or liquid.

In order to prevent such a problem, in some embodiments of the present disclosure, the aerosol generation device 6 may further include an aerosol heater (not illustrated) disposed between the cartridge 63 and the mouthpiece 61. The aerosol heater (not illustrated) may include an airflow tube configured to deliver the aerosol to the mouthpiece 61 and may re-heat the aerosol passing through the airflow tube. As the aerosol is re-heated, the user may feel the warmth of the aerosol as when smoking a general cigarette, and it is possible to prevent the phenomenon in which the user inhales the aerosol in the form of droplets or liquid that occurs as the aerosol with a decreased temperature is liquefied again.

Also, in some embodiments, the aerosol heater (not illustrated) may also heat at least a portion of the mouthpiece 61. The aerosol heater (not illustrated) may heat at least a portion of the mouthpiece 61 so that the user feels warmth when holding the mouthpiece 61 in his or her mouth. Accordingly, not only the warmth through the aerosol, but also the warmth felt from contact with the mouthpiece 61 may be provided to the user. Also, a smoking experience identical to that from a general cigarette may be provided to the user.

Also, in some embodiments, the mouthpiece 61 may include an aluminum thin film surrounding at least a portion of the mouthpiece 61. Accordingly, when at least a portion of the mouthpiece 61 is heated by the aerosol heater (not illustrated), heat conductivity from the aerosol heater (not illustrated) may be increased, and a feeling of warmth as when smoking a general cigarette may be provided to the user more effectively.

Hereinafter, hybrid-type aerosol generation devices 7 and 8 will be briefly described with reference to FIGS. 10 and 11. Since functions of a cartridge 71, a controller 73, and a battery 75 of the aerosol generation device 7 illustrated in FIG. 10 and functions of a cartridge 81, a controller 83, and a battery 85 of the aerosol generation device 8 illustrated in FIG. 11 are similar to those described above, descriptions thereof will be omitted.

FIG. 10 is an exemplary block diagram of the aerosol generation device 7 in which the cartridge 71 and a cigarette 77 are arranged in parallel, and FIG. 11 is an exemplary block diagram of the aerosol generation device 8 in which the cartridge 81 and a cigarette 87 are arranged in series. However, the inner structures of the aerosol generation devices to which the cartridges 1, 4, 71, and 81 according to various embodiments of the present disclosure are applied are not limited to those shown in FIGS. 10 and 11, and the arrangement of the elements may be changed according to design methods.

The aerosol generation devices according to various embodiments of the present disclosure have been described above with reference to FIGS. 9 to 11.

All the elements constituting the embodiments of the present disclosure have been described above as being combined into one body or being operated in combination, but the technical idea of the present disclosure is not necessarily limited to the embodiments. That is, any one or more of the elements may be selectively operated in combination within the intended scope of the present disclosure.

The embodiments of the present disclosure have been described above with reference to the accompanying drawings, but those of ordinary skill in the art to which the present disclosure pertains should understand that the present disclosure may be embodied in other specific forms without changing the technical idea or essential features thereof. Therefore, the embodiments described above should be understood as being illustrative, instead of limiting, in all aspects. The scope of the present disclosure should be interpreted by the claims below, and any technical idea within the scope equivalent to the claims should be interpreted as falling within the scope of the technical idea defined by the present disclosure.

What is claimed is:

1. A liquid cartridge comprising:

a storage portion having an accommodating space configured to store an aerosol-generating substrate in a liquid state, a wick having two ends and configured to absorb the aerosol-generating substrate that is stored in the accommodating space at the two ends, wherein one or more portions of the wick, excluding the two ends of the wick, are surrounded by a wick housing;

an air hole configured to introduce air into the accommodating space storing the aerosol-generating substrate in the liquid state and disperse positions where bubbles are generated in the accommodating space to other positions instead of near the two ends of the wick; and a vaporizing portion configured to generate an aerosol by vaporizing the aerosol-generating substrate absorbed in the wick, wherein the air hole is disposed at a connection portion between the wick housing and the storage portion to introduce air inside the wick housing into the accommodating space to generate bubbles near the air hole and disperse positions where bubbles are generated, and wherein in a state in which the user's mouth is upward, the air hole is disposed at a lower end of the storage portion and above of the wick.

2. The liquid cartridge of claim 1, wherein a size of the air hole is in a range of 0.15 $mm^2$ to 0.60 $mm^2$.

3. The liquid cartridge of claim 1, further comprising an airflow tube through which the generated aerosol or air is delivered, wherein the air hole is further disposed at a second connection portion between the airflow tube and the storage portion such that air inside the airflow tube is introduced into the accommodating space storing the aerosol-generating substrate in the liquid state that is stored in the storage portion.

4. The liquid cartridge of claim 1, wherein the wick housing includes a porous material.

5. The liquid cartridge of claim 1, wherein the air hole includes a plurality of holes forming a mesh structure.

6. The liquid cartridge of claim 1, wherein the air hole comprises a semipermeable membrane configured to prevent the stored aerosol-generating substrate from leaking out of the accommodating space.

7. The liquid cartridge of claim 1, wherein the air hole includes a first air hole disposed at a first position in the storage portion and a second air hole disposed at a second position in the storage portion.

8. The liquid cartridge of claim 1, further comprising:

a first airflow tube configured to introduce air into the liquid cartridge; and a second airflow tube configured to deliver the generated aerosol to outside of the liquid cartridge together with air.

9. A liquid cartridge comprising:

a storage portion having an accommodating space configured to store an aerosol-generating substrate in a liquid state;

a wick having two ends and configured to absorb the aerosol-generating substrate that is stored in the accommodating space at the two ends, wherein one or more portions of the wick, excluding the two ends of the wick, is surrounded by a wick housing;

a semipermeable material that prevents the stored aerosol-generating substrate from leaking out of the accommodating space and allows air to be introduced into the accommodating space storing the aerosol-generating substrate in the liquid state;

a vaporizing portion configured to generate an aerosol by vaporizing the aerosol-generating substrate absorbed in the wick;

wherein the semipermeable material is disposed at a connection portion between the wick housing and the storage portion, wherein the semipermeable material between the storage portion and the wick housing is configured to disperse positions where bubbles are generated in the accommodating space to other positions instead of near the two ends of the wick, and wherein air inside the wick housing is introduced into the accommodating space portion storing the aerosol-generating substrate in the liquid state via the semipermeable material between the storage portion and the wick housing.

10. The liquid cartridge of claim 9, further comprising an airflow tube configured to deliver the generated aerosol or air, wherein a connection portion between the airflow tube and the storage portion includes the semipermeable material such that air inside the airflow tube is introduced into the accommodating space storing the aerosol-generating substrate in the liquid state via the semipermeable material between the airflow tube and the storage portion.

* * * * *